US005377298A

United States Patent [19]

Yang

[11] Patent Number: 5,377,298

[45] Date of Patent: Dec. 27, 1994

[54] CASSETTE PTC SEMICONDUCTOR HEATING APPARATUS

[76] Inventor: Chiung-hsiang Yang, c/o Hung Hsing Patent Service Center P.O. Box 55-1670, Taipei (10477), Taiwan, Prov. of China

[21] Appl. No.: 49,351

[22] Filed: Apr. 21, 1993

[51] Int. Cl.[5] ..... H05B 3/14

[52] U.S. Cl. ..... 392/360; 219/504; 219/530; 219/532; 392/365

[58] Field of Search ..... 219/202, 504, 505, 530, 219/532; 392/360–369, 403

[56] References Cited

U.S. PATENT DOCUMENTS

| | | | |
|---|---|---|---|
| 4,855,570 | 8/1989 | Wang | 219/505 |
| 4,855,571 | 8/1989 | Ting | 219/532 |
| 5,057,672 | 10/1991 | Bohlender | 219/202 |
| 5,192,853 | 3/1993 | Yeh | 219/530 |
| 5,198,640 | 3/1993 | Yang | 219/530 |
| 5,239,163 | 8/1993 | Brouwers | 219/202 |
| 5,256,857 | 10/1993 | Curhan | 219/202 |

*Primary Examiner*—Teresa J. Walberg

[57] ABSTRACT

A PTC semiconductor heating device includes: two half shells combinable for forming a housing of the semiconductor heating device, a plurality of linear arrays of PTC semiconductor heating elements parallelly mounted in the housing with each linear array containing a plurality of PTC semiconductor heating elements longitudinally disposed in a side-by-side linear arrangement in said housing and each linear array of PTC heating elements being sandwiched in between every two neighboring thermally and electrically conducting units respectively connected to two poles of a power source and longitudinally juxtapositionally mounted in the housing each thermally and electrically conducting unit including a corrugated fin plate formed with a plurality of continuous square waves and clamped by a pair of conducting plates, and a plurality of resilient embedding plates each embedding plate resiliently inserted in between every two neighboring thermally and electrically conducting units for firmly tensioning, packing and retaining all the PTC heating elements, the conducting units and the embedding plate in the housing to eliminate any welding or bonding joint processing for their assembly for saving production cost and enhancing heating efficiency thereof.

13 Claims, 5 Drawing Sheets

CASSETTE PTC SEMICONDUCTOR HEATING APPARATUS

BACKGROUND OF THE INVENTION conventional dryer or heater for blowing heated air as shown in FIG. 7 is formed by binding each PTC semiconductor heating element H in between two aluminum-plate frames A by adhesive S, each aluminum frame A confining a corrugated fin F within each frame A with the fin F fixed to the frame A by adhesive S such as by silicon adhesive, and each pair of terminals T connected to a power source being electrically connected to two poles of each PTC semiconductor heating element H for passing current through each PTC element H for heating air blown through the PTC elements H for heating purpose.

However, such a conventional dryer has the following drawbacks:

1. Due to different coefficients of heat expansion of the aluminum frame A and PTC element H, and due to the exposure of the silicon adhesive under high temperature to cause curing, breakage and cleavage of the adhesive binding, a sparking gap may occur between each PTC heating element H and each aluminum plate A to cause sparking, short-circuit or explosion hazards. The conducting surface on each PTC heating element H, as influenced by the silicon adhesive subjected to thermal shock when heated and cooled, may be easily oxidized to produce high impedance which in turn may cause partial over-current and over-heating of the PTC element, shortening the service life of PTC element or even explosion hazard thereof.
2. The binding of PTC element with aluminum plate A or aluminum plate A with fin F should be processed or welded from point to point to increase production cost and quality control problems.
3. The fin S forms a "point" contact with the aluminum plate A rather than a "surface" contact to thereby reduce the heat-exchange area and decrease the heating efficiency. Meanwhile, the "point" contact between the corrugated fin F with the aluminum plate A may be accumulated with dusts and dirts to increase wind resistance and decrease heat-exchange efficiency therefore.
4. The aluminum plate A contacted with the PTC element H is directly secured with a terminal T which is connected to power source without any fuse. Once a short-circuit and sparking accident is caused, the PTC heater may be burned. During the manufacturing of the PTC elements, the clearance of thinner PTC element may be loosened in the assembly of PTC elements to produce sparking gap which may cause fire or explosion hazard of the PTC heater when passing current therethrough.

The present inventor has found the drawbacks of a conventional PTC dryer or heater, and invented the present cassette type PTC heating device.

SUMMARY OF THE INVENTION

The object of the present invention is to provide a PTC semiconductor heating device including: two half shells combinable for forming a housing of the semiconductor heating device, a plurality of linear arrays of PTC semiconductor heating elements parallelly mounted in the housing with each linear array containing a plurality of PTC semiconductor heating elements longitudinally disposed in a side-by-side linear arrangement in said housing and each linear array of PTC heating elements being sandwiched in between every two neighbouring thermally and electrically conducting units respectively connected to two poles of a power source and longitudinally juxtapositionally mounted in the housing each thermally and electrically conducting unit including a corrugated fin plate formed with a plurality of continuous square waves and clamped by a pair of conducting plates, and a plurality of resilient embedding plates each embedding plate resiliently inserted in between every two neighbouring thermally and electrically conducting units for firmly tensioning, packing and retaining all the PTC heating elements, the conducting units and the embedding plate in the housing to eliminate any welding or bonding joint processing for their assembly for saving production cost and enhancing heating efficiency thereof.

DETAILED DESCRIPTION

Figure 1:
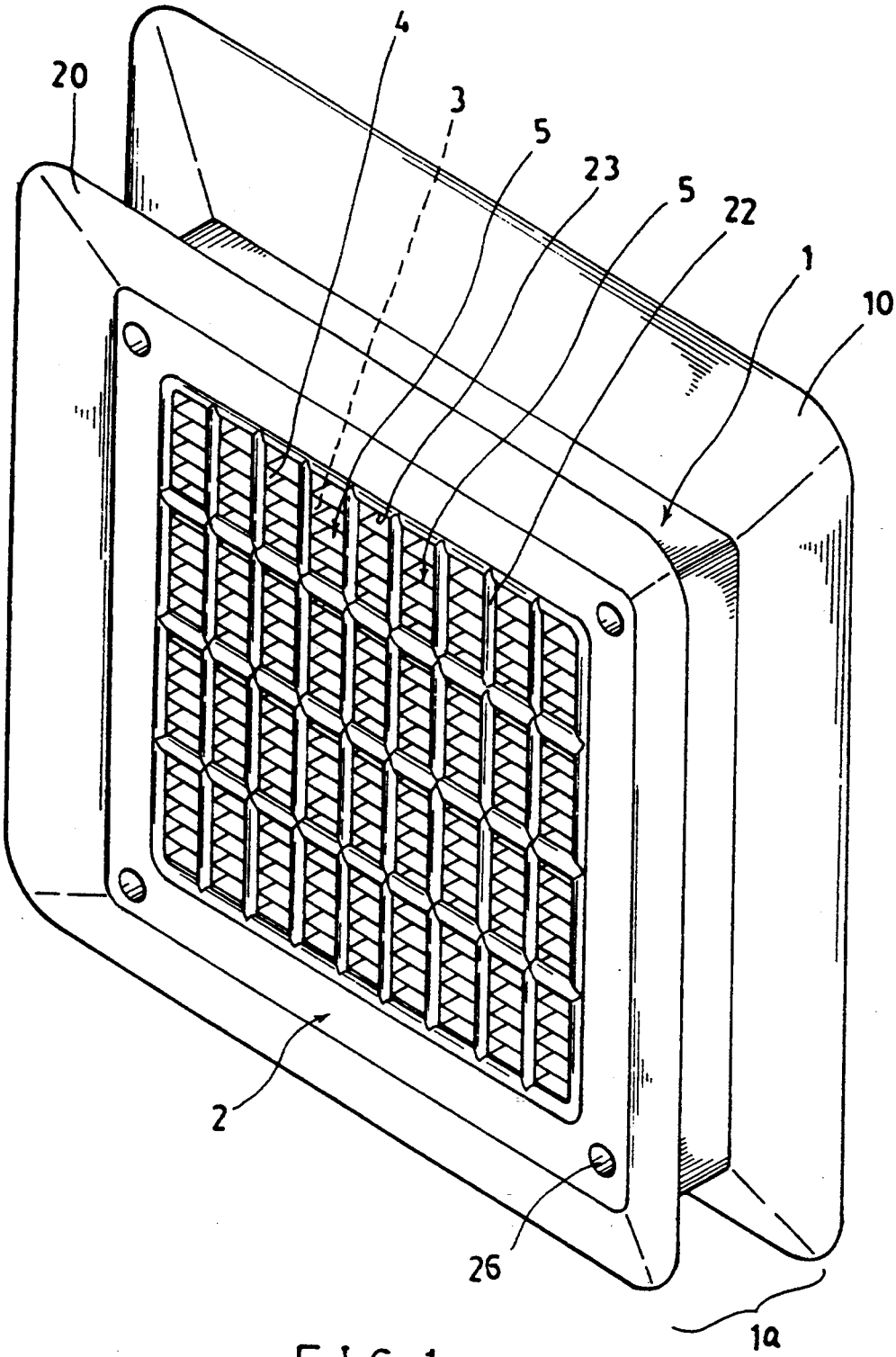
FIG. 1 is perspective view of the present invention when assembled.
Figure 2:
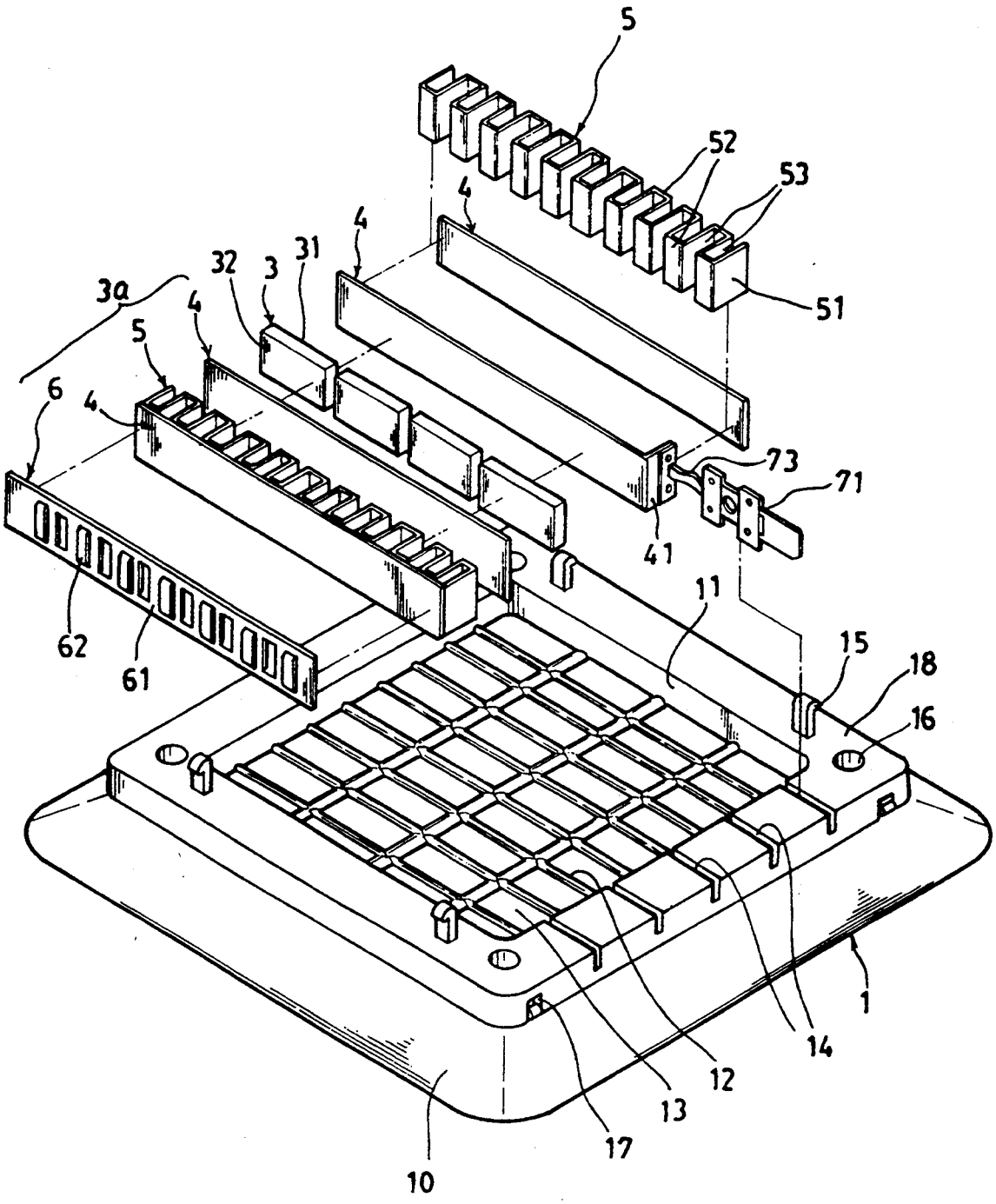
FIG. 2 is an exploded view showing major elements in construction of the present invention.

As shown in FIGS. 1–6, the present invention comprises: a first half shell 1, a second half shell 2, a plurality of PTC semiconductor heating elements 3, a plurality of thermally and electrically conducting units 3*a* with every two conducting units 3*a* disposed on two opposite sides of each array of PTC semiconductor heating elements 3 with each conducting unit 3*a* containing a corrugated fin plate 5 disposed in between two metallic conducting plates 4, and a plurality of resilient embedding plates 6 each embedding plate 6 resiliently inserted in between every two neighbouring conducting units 3*a*; two respective thermally and electrically conducting units 3*a* disposed on two opposite sides of each PTC semiconductor heating element 3 for contacting two opposite electrode surfaces 31, 32 of each PTC semiconductor heating element 3, and respectively connected to two poles of a power source 7 through two fuses 73 each fuse 73 connected between each respective terminal plate 71 or 72 of each thermally and electrically conducting unit 3*a*and each respective pole of a power source 7.

Figure 5:
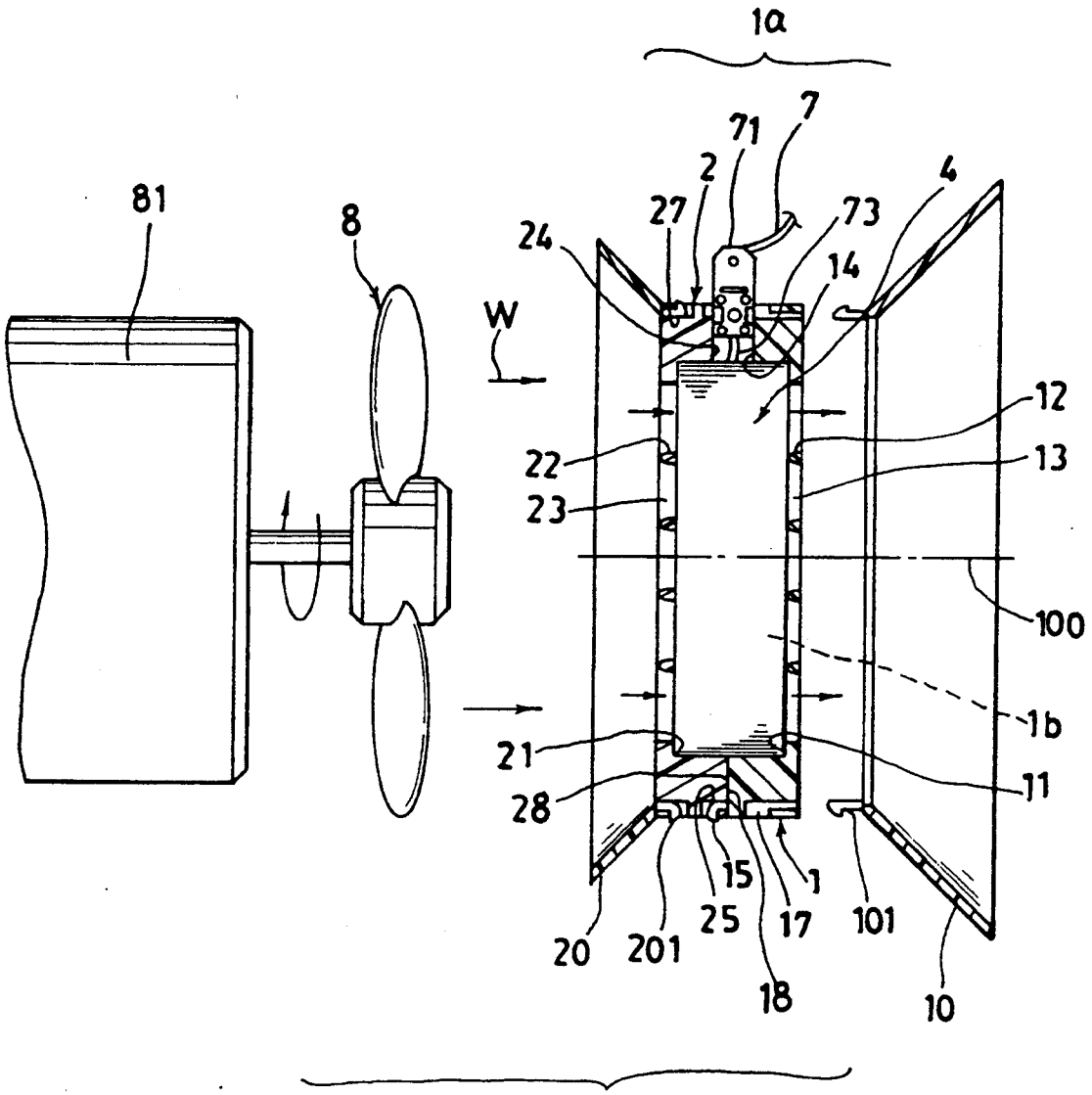
FIG. 5 is a sectional illustration of the present invention as being a assembled.

As shown in FIG. 5, a fan 8 driven by a driving motor 81 is provided to blow air W through the PTC heating elements 3 for supplying heated air for drying purpose.

The shapes of a housing 1*a* composed of the first and the second half shells 1, 2 and the depth or length of the housing 1*a* for passing air therethrough are not limited in this invention.

The first half shell I is made of heat resistant and electrically insulative materials and includes: a first base socket 11 recessed in a central portion of the first half shell 1 to form a first frame 18 circumferentially disposed around the first base socket 11, a first grating 12 formed with crosslinking net structure secured to an outer edge portion of the first frame 18 having a plurality of first ventilation holes 13 formed in the grating 12, a plurality of first terminal slits 14 longitudinally recessed in a side portion of the first frame 18 for engaging each terminal plate 71 or 72 connected to a power source 7, and a plurality of tenons 15 formed on the first frame 18. The first grating 12 extrapolatively defines a plane generally perpendicular to an air flow direction W through the ventilation holes 13 in the first half shell 1.

The first half shell 1 is formed with a plurality of pin holes 17 engageable with a plurality of first coupling pins 101 of a first hood member 10 for securing the first hood member 10 with the first half shell 1 for guiding air flow W as shown in FIG. 5 when combined with a second half shell 2.

The second half shell 2 is made of heat resistant and electrically insulative materials and includes: a second base socket 21 recessed in a central portion of the second half shell 2 to form a second frame 28 circumferentially disposed around the second base socket 21, a second grating 22 parallel to the first grating 12 formed with crosslinking net structure secured to an outer edge portion of the second frame 28 having a plurality of second ventilation holes 23 formed in the grating 22, a plurality of second terminal slits 24 longitudinally recessed in a side portion of the second frame 28 for engaging each terminal plate 71 or 72 connected to a power source 7 in cooperation with the first terminal slits 14 in the first half shell 1, and a plurality of tenon sockets 25 formed on the second frame 28 engageable with the tenons 15 of the first half shell 1 for combining the two half shells 1, 2 for forming a housing 1*a*.

The second half shell 2 is formed with a plurality of pin holes 27 engageable with a plurality of second coupling pins 201 of a second hood member 20 for securing the second hood member 20 with the second half shell 2 for guiding air flow W as shown in FIG. 5 when combined with the first half shell 1.

The first and the second half shells 1, 2 may be formed with a plurality of bolt holes 16, 26 in the first and second frames 18, 28 for fixing the two shells 1, 2 on any mounting bracket, structure or fixture.

The first half shell 1 once combined with the second half shell 2 to form a housing 1*a* will confine an air duct 1*b* within the first and the second base sockets 11, 21 having a housing axis 100 transversely defined in a center portion of the housing 1*a* and being parallel to an air flow direction W when blown by the fan 8 into the air duct 1*b* in the housing 1*a*.

Each grating 12, 22 may be tapered frontwardly to face the fan 8 in order to reduce wind resistance when operating the present invention.

The hood members 10, 20 may also be integrally formed with the first and second half shells 1, 2 without providing any tenon and tenon holes as aforementioned. Also, the hood members 10, 20 may also be omitted.

Two poles of the power source 7 are electrically connected to two terminal plates, i.e., a first electrode terminal plate 71 and a second electrode terminal plate 72 respectively connected through two fuses 73 to two thermally and electrically conducting units 3*a* disposed on two opposite sides of each PTC semiconductor heating element 3. Either terminal plate 71 or 72 is inserted in each terminal slit 14, 24 respectively recessed in two half shells 1, 2 of a housing 1*a*.

Each thermally and electrically conducting unit 3*a* includes: an elongated fin plate 5 corrugated and continuously wound with a plurality of square waves sandwiched in between two elongated conducting plates 4 which may be electrically conductive metallic plates to form a generally rectangular shape from a longitudinal side view of each thermally and electrically conducting unit 3*a* which is embedded in the base sockets 11, 21 in the housing 1*a* to be juxtapositional to each side of each PTC semiconductor heating element 3 and to be tangential to an air flow direction W parallel to the housing axis 100.

One elongated conducting plate 4 contacted with a first electrode surface 31 of one PTC semiconductor heating element 3 is formed with a bending edge portion 41 on one end portion of the conducting plate 4 to connect a fuse 73 which is connected to a first electrode terminal plate 71 connectable with a first pole of a power source 7; while the other elongated conducting plate 4 connectable to a second electrode surface 32 of the PTC semiconductor heating element 3 is also formed with a bending edge portion 41 on one end portion of the conducting plate 4 to connect another fuse which is connected to a second electrode terminal plate 72 connected with a second pole of the power source 7, thereby directing electric current through two electrode surfaces 31, 32 of each PTC heating element for producing heat.

The bending edge portion 41 of the conducting plate 4 may also be omitted in this invention.

Each elongated fin plate 5 includes each latitudinal blade portion 51 continuously integrally connected with each longitudinal blade portion 52 to be perpendicular to each other, each latitudinal blade portion 51 followed with each longitudinal blade portion 52 being repeatedly wound to form a plurality of continuous square-wave forms to form a plurality of ventilation passages 53 through the blade portions 51, 52 to be communicated with a plurality of ventilation holes 13, 23 formed in a first and a second half shells 1, 2 for passing air flow W therethrough (FIGS. 6, 3), with each longitudinal blade portion 52 planarly contacting each elongated conducting plate 4 abutting the fin plate 5 for a better heat transfer between the fin plate 5 and conducting plate 4.

Figure 3:
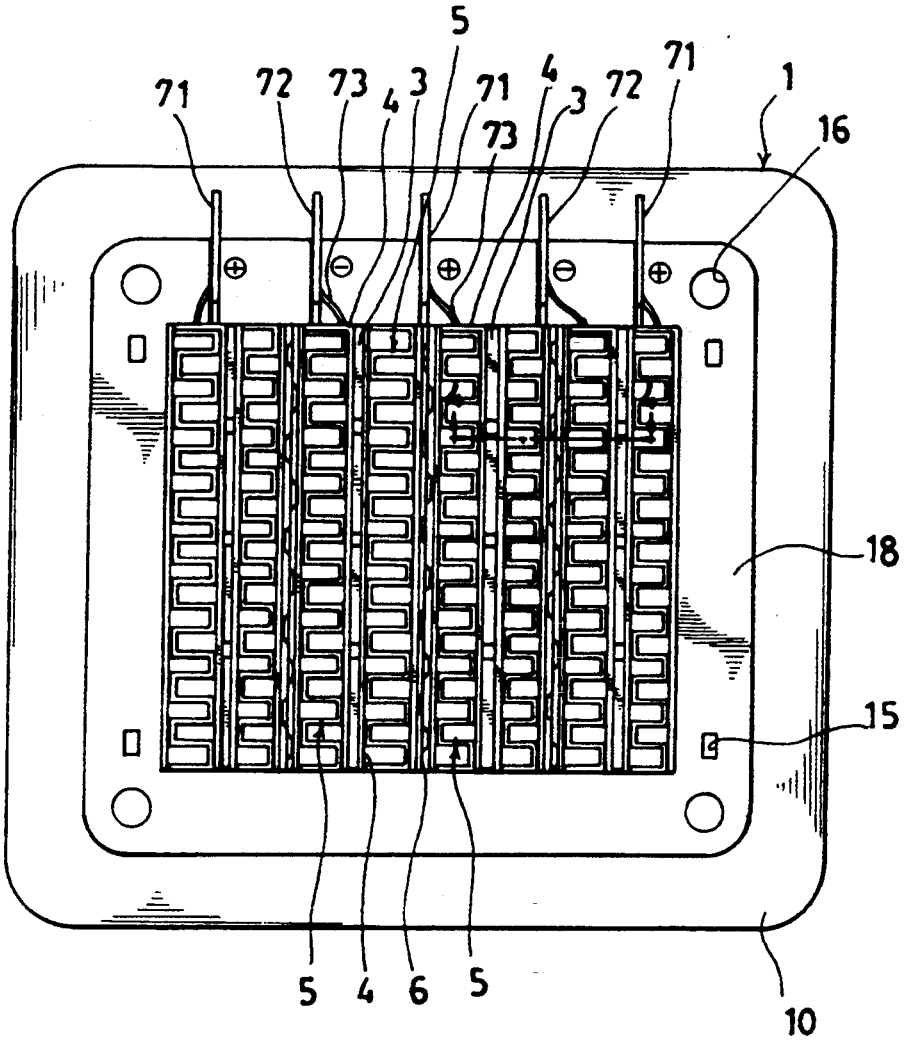
FIG. 3 is a top view illustration of the present invention when assembled from FIG. 2.
Figure 6:
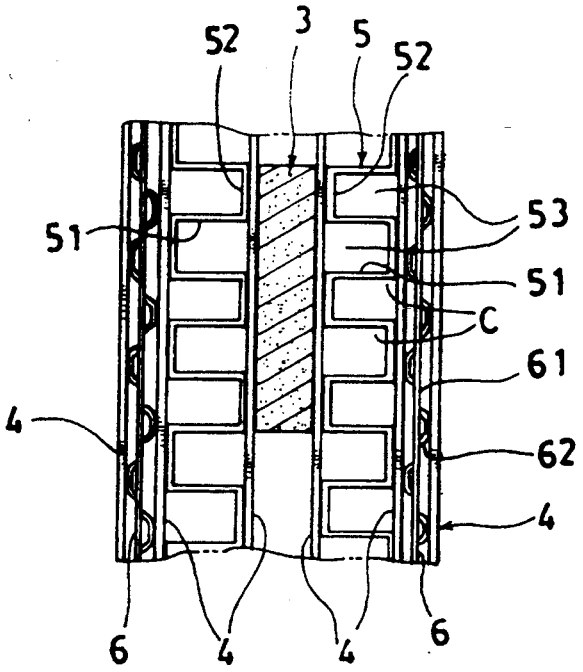
FIG. 6 is a partial enlarged illustration when viewed from FIG. 3.

Each resilient embedding plate 6 is also made of electrically conductive and thermally conductive materials, such as stainless steel or steel plate, and includes: an elongated flat plate member 61 having a plurality of protrusions 62 directly transversely punched on the elongated flat plate member 61 to have a longitudinal projective view of the protrusions 62 alternatively or sinuously protruded from the flat plate member 61 as shown in FIGS. 6, 3 for a balancing elastic insertion of each embedding plate 6 in between every two neighbouring thermally and electrically conducting units 3*a*to firmly retain all the PTC heating elements 3 and the conducting units 3*a*into the sockets 11, 21 in the housing 1*a* as squeezed by the embedding plates 6 longitudinally juxtaposed in the sockets 11, 21 of the housing 1*a*.

Figure 4:
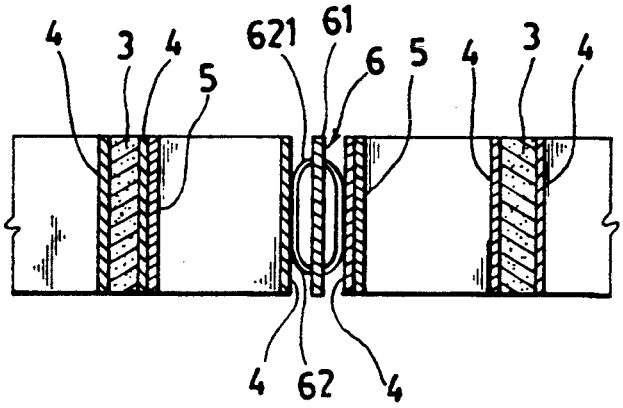
FIG. 4 is a partial sectional drawing when viewed from 4—4 direction of FIG. 3.

As shown in FIG. 4, each protrusion 62 of the embedding plate member 61 has two taper portions 621 tapered transversely towards two side edge portions of the flat plate member 61 for an easy insertion of the embedding plate 6 into an aperture between every two thermally and electrically conducting units 3*a*when embedded in the sockets 11, 21 of the housing 1*a*.

Each linear array of the PTC semiconductor heating elements 3 has a width slightly smaller than a width of each grating 12, 22 formed in each half shell 1, 2 so that each grating 12, 22 will shield each array of PTC heating elements 3 to preclude any intrusion of an external object (electrically conductive) into the sockets 11, 21 of the housing 1*a* to touch the PTC element 3 to prevent a short-circuit or sparking accident.

When mounting and assembling the present invention, each conducting unit 3*a* and each array of the PTC heating elements 3 are subsequently 1*a* id into a first socket 11 of the first half shell 1 to pack all the PTC elements 3 and the conducting units 3*a* including conducting plates 4 and fin plates 5 into the sockets 11 of the first shell 1, and then a plurality of the embedding plates 6 are parallelly inserted into the arrays of the conducting units 3*a* for resiliently tensioning, packing, squeezing and holding all the elements into the socket 11 of the first shell 1 which is then covered with second shell 2 and further combined by fixing bolts (not shown) therebetween.

Figure 7:
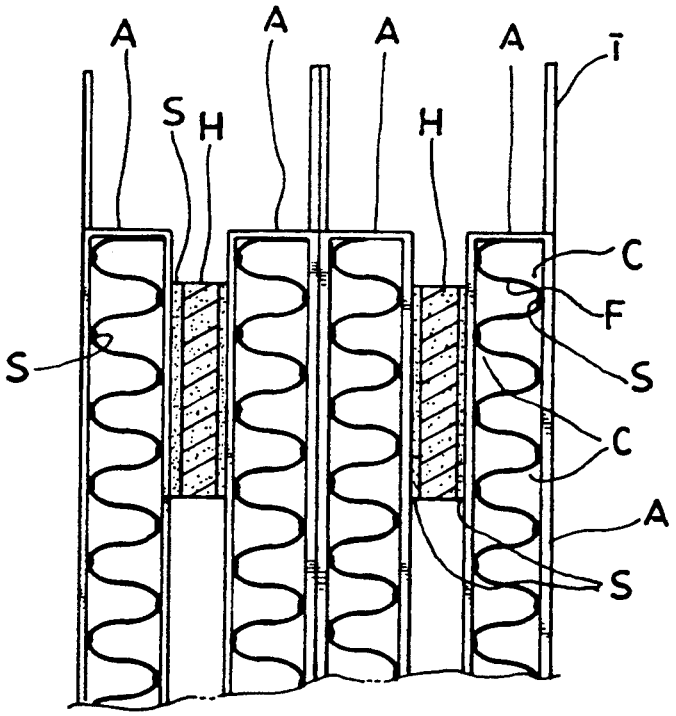
FIG.7 PRIOR ART
FIG. 7 shows a prior art of a conventional PTC heater.

Therefore, this invention provides a PTC heater having the following advantages superior to any prior arts:

1. All the elements are embedded in the housing 1 without any welding processing for saving production cost.
2. An adhesive used in a conventional PTC heater is now eliminated to thereby prevent any drawbacks such as curing, breakage, overcurrent, shortcircuit, sparking and explosion caused by the conventional PTC heater bonded with adhesive.
3. The embedding plates 6 are provided to squeeze the insertion of all PTC elements 3, fin plates 5 and conducting plates 4 in the sockets 11, 21 of the housing 1*a* to thereby firmly closely pack all parts in the housing to enhance heat transfer and current conductance therebetween to increase heating efficiency and prevent accident of shortcircuit, sparking or even explosion.
4. The fin plate 5 has the square-wave shaped blade portions 51, 52 to increase thermal contacting or conducting areas for better heat exchange operation to thereby increase an overall heating efficiency of the present invention. Meanwhile, the square-wave shaped fin plate will reduce those small acute-angle "corners"(C) easily accumulated with dirts and dusts as found in a conventional heater as shown in FIG. 7 to thereby reduce the wind resistance because the right-angle "corners"(C) of this invention will be clearly purged by the air flow W by comparing FIG. 6 (this invention) with FIG. 7 (the prior art).

I claim:

1. A PTC semiconductor heating apparatus comprising:

a first half shell and a second half shell each half shell having a base socket recessed therein and both shells combinable for forming a housing;

a plurality of linear arrays of PTC semiconductor heating elements parallelly embedded in said base sockets in said housing with each said linear array of PTC semiconductor heating elements containing a plurality of PTC semiconductor heating elements longitudinally disposed in a side-by-side linear arrangement in said base sockets of said housing, each said linear array of PTC semiconductor heating elements sandwiched in between two neighbouring thermally and electrically conducting units longitudinally juxtapositionally mounted in the housing;

two said thermally and electrically conducting units disposed on two opposite sides of each said linear array of said PTC semiconductor heating elements electrically connected to two poles of a power source; and a plurality of resilient embedding plates each said embedding plate inserted in between every two neighbouring thermally and electrically conducting units for firmly squeezing, packing and retaining said conducting units and said PTC semiconductor heating elements in said housing without welding and bonding joining.

2. A PTC semiconductor heating apparatus according to claim 1, wherein said first half shell is made of heat resistant and electrically insulative materials and includes: a first base socket recessed in a central portion of the first half shell to form a first frame circumferentially disposed around the first base socket, a first grating formed with crosslinking net structure secured to an outer edge portion of the first frame having a plurality of first ventilation holes formed in the first grating, a plurality of first terminal slits longitudinally recessed in a side portion of the first frame, and a plurality of tenons formed on the first frame, with said first grating extrapolatively defining a plane generally perpendicular to an air flow direction through the ventilation holes in the first half shell.

3. A PTC semiconductor heating apparatus according to claim 2, wherein said first half shell is formed with a plurality of pin holes engageable with a plurality of first coupling pins of a first hood member for securing the first hood member with the first half shell for guiding air flow when combined with a second half shell.

4. A PTC semiconductor heating apparatus according to claim 3, wherein said second half shell is made of heat resistant and electrically insulative materials and includes: a second base socket recessed in a central portion of the second half shell to form a second frame circumferentially disposed around the second base socket, a second grating parallel to the first grating formed with crosslinking net structure secured to an outer edge portion of the second frame having a plurality of second ventilation holes formed in the second grating, a plurality of second terminal slits longitudinally recessed in a side portion of the second frame, and a plurality of tenon sockets formed in the second frame engageable with the tenons of the first half shell for combining the two half shells for forming a housing.

5. A PTC semiconductor heating apparatus according to claim 4, wherein said second half shell is formed with a plurality of pin holes engageable with a plurality of second coupling pins of a second hood member for securing the second hood member with the second half shell for guiding air flow when combined with the first half shell.

6. A PTC semiconductor heating apparatus according to claim 5, wherein said first half shell as combined with the second half shell to form a housing confines an air duct within the first and the second base sockets in said housing having a housing axis transversely defined in a center portion of the housing and being parallel to an air flow direction when blown by a fan into the air duct in the housing.

7. A PTC semiconductor heating apparatus according to claim 1, wherein said power source having two poles electrically connected to a first electrode terminal plate and a second electrode terminal plate respectively connected through two fuses to two thermally and electrically conducting units disposed on two opposite sides of each said PTC semiconductor heating element, each said terminal plate inserted in a terminal slit recessed in either of the two shells of the housing.

8. A PTC semiconductor heating apparatus according to claim 1, wherein each said thermally and electrically conducting unit includes: an elongated fin plate corrugated and continuously wound with a plurality of square waves sandwiched in between two elongated conducting plates, each said thermally and electrically conducting unit embedded in the base sockets of the housing being juxtapositional to each side of each said PTC semiconductor heating element and to be tangential to an air flow direction in the housing.

9. A PTC semiconductor heating apparatus according to claim 8, wherein one said elongated conducting plate is contacted with a first electrode surface of one said PTC semiconductor heating element having a bending edge portion formed on one end portion of the conducting plate to connect a first fuse which is connected to a first electrode terminal plate connectable to a first pole of a power source; and another elongated conducting plate is connectable to a second electrode surface of the PTC semiconductor heating element having a bending edge portion formed on one end portion of the conducting plate to connect a second fuse which is connected to a second electrode terminal plate connected with a second pole of the power source for directing electric current through two electrode surfaces of each PTC heating element for producing heat.

10. A PTC semiconductor heating apparatus according to claim 8, wherein each said elongated fin plate includes a latitudinal blade portion continuously integrally connected with a longitudinal blade portion to be perpendicular to each other, each said latitudinal blade portion followed with each said longitudinal blade portion being repeatedly wound to form a plurality of continuous square-wave forms to form a plurality of ventilation passages through the blade portions to be communicated with a plurality of ventilation holes formed in said first and a second half shells for passing air flow therethrough, with each said longitudinal blade portion planarly contacting each said elongated conducting plate abutting the fin plate for a better heat transfer between the fin plate and conducting plate.

11. A PTC semiconductor heating apparatus according to claim 1, wherein each said resilient embedding plate is made of electrically conductive and thermally conductive materials, and includes: an elongated flat plate member having a plurality of protrusions directly transversely punched on the elongated flat plate member to have a longitudinal projective view of the protrusions alternatively sinuously protruded from the flat plate member for a balancing elastic insertion of each embedding plate in between every two neighbouring thermally and electrically conducting units to firmly retain all the PTC heating elements and the conducting units into the sockets in the housing as squeezed by the embedding plates longitudinally juxtaposed in the sockets of the housing.

12. A PTC semiconductor heating apparatus according to claim 11, wherein each said protrusion of the embedding plate member has two taper portions tapered transversely towards two side edge portions of the flat plate member for an easy insertion of the embedding plate into an aperture between every two thermally and electrically conducting units when embedded in the sockets of the housing.

13. A PTC semiconductor heating apparatus according to claim 1, wherein each said linear array of the PTC semiconductor heating elements has a width slightly smaller than a width of a grating formed in each said half shell to allow each said grating to shield each said array of PTC semiconductor heating elements.

* * * * *